United States Patent [19]

Nemeth et al.

[11] Patent Number: 4,677,268

[45] Date of Patent: Jun. 30, 1987

[54] ELASTOMERIC SWITCH CONTROL DEVICE

[75] Inventors: Joseph C. Nemeth; Richard L. Watkins, Westminster, both of Colo.

[73] Assignee: The Gates Corporation, Denver, Colo.

[21] Appl. No.: 479,540

[22] Filed: Mar. 28, 1983

[51] Int. Cl.[4] ..... H01H 13/52

[52] U.S. Cl. ..... 200/159 B

[58] Field of Search ..... 200/159 B

[56] References Cited

U.S. PATENT DOCUMENTS

| | | | |
|---|---|---|---|
| 3,478,857 | 11/1969 | Linker | 200/159 R |
| 3,829,646 | 8/1974 | Lorteije et al. | 200/159 B |
| 3,932,722 | 1/1976 | Obata et al. | 200/159 B X |
| 4,194,105 | 3/1980 | Hodges | 200/159 B |
| 4,286,129 | 8/1981 | Petit | 200/159 B |
| 4,289,943 | 9/1981 | Sado | 200/159 B |
| 4,315,114 | 2/1982 | Monti, Jr. | 200/159 B X |
| 4,366,355 | 12/1982 | Oelsch | 200/159 B |
| 4,378,478 | 3/1983 | Deeg | 200/159 B |
| 4,390,765 | 6/1983 | Sado et al. | 200/159 B |

*Primary Examiner*—Stephen Marcus
*Assistant Examiner*—Renee S. Luebke
*Attorney, Agent, or Firm*—C. H. Castleman, Jr.; H. W. Oberg, Jr.; F. P. Grassler

[57] ABSTRACT

An elastomeric switch control element for push button switches and the like, including first and second annular spring portions formed of elastic material, one of the spring portions adapted to undergo a rolling action upon depression of the switch control element, and the other annular portion adapted to flex and undergo a snap transformation to provide a tactile feel to the operator.

19 Claims, 11 Drawing Figures

ELASTOMERIC SWITCH CONTROL DEVICE

BACKGROUND OF THE INVENTION

This invention relates to switches and particularly to resilient switch control devices which provide a tactile sensation to the operator as the switch is depressed.

Individual key switches and keyboards (having multiple switches) are used in such diverse products as data input terminals, typewriters, computers, appliances, cash registers, calculators and electronic games. Individual keys typically have inscribed thereon alphanumeric characters or other symbols. When depressed by the operator typically a circuit is closed which provides an output which may be stored or which causes performance of a particular operation. Various spring control devices are used to ensure that a depressed key returns to its original or neutral position after release. In addition to the traditional use of helical springs for this purpose, there has been an increased use of elastic materials to provide the needed return force.

The desirability of designing the elastomeric spring control device to provide the operator with a tactile feel at or prior to the switch triggering or makepoint is recognized as being desirable, particularly in the so-called full travel keyboards. In this manner a steep dropoff of reaction force results as the elastomeric material undergoes a snap transformation confirming to the operator that positive contact has been achieved. Typical prior art elastomeric control devices which provide at least some tactile feedback to the operator include U.S. Pat. Nos. 3,478,857 to Linker; 3,603,756 to Carpentier et al; 3,829,646 to Lorteije et al; 3,932,722 to Obata et al; 4,127,752 and 4,127,758 both to Lowthorp; 4,354,068 to Sobol; and 4,362,911 to Sears et al. In addition, U.S. Pat. No. 4,289,943 to Sado is pertinent however according to the invention of that patent the elastomeric control device is depressed for a relatively short distance before the switch triggering point is made. With a further pushing force the circuit is opened and it is only then that the switch control device undergoes a snap transformation, reportedly for the purpose of reducing "bounce" and "chatter".

Despite the tactile feel offered by these prior art devices, they have not provided a sufficiently steep dropoff in force at the breakover point at snap to simulate a highly successful and commercially available QWERTY keyboard which utilizes effective but quite expensive electromechanical switch controls.

Moreover, most of the prior art devices do not provide sufficiently long pretravel of the key prior to the breakover or snap point for failsafe operation. This has resulted in an overly touchy feel in which the operator can inadvertently trigger the switch.

Among the objects of the subject invention are to overcome the aforementioned drawbacks and specifically to provide a switch control device which is characterized by a long pretravel prior to snap; in particular to shift the force displacement curve such that the snap or breakover occurs after approximately the half-way point in total key displacement; to preferably increase the tactile feel sensed by the operator by providing a substantially increased incremental drop in force per unit of displacement, after the breakover or snap point; to provide a return force/displacement characteristic which has a relatively low force level that does not push as strongly against the operator's finger during return of the depressed key; and in general to provide a relatively low cost, long life reliable switch control device and switching mechanism which is easy to produce from available moldable elastomeric materials and which offers selectivity in operational characteristics by adjustment of different spring component portions of the control device, and which preferably tends to self-center even when subjected to off-center applied force.

SUMMARY OF THE INVENTION

Briefly described, the invention comprehends an elastomeric switch control element providing a tactile feel in operation thereof, comprising a central portion which includes a switch actuation means; a first annular spring portion, attached to the central portion, adapted to flex and after predetermined axial displacement of the central portion in excess of a breakover amount, to undergo a snap transformation; and a second annular spring portion, coaxially arranged with and attached to the first annular spring portion, adapted to undergo a rolling action upon axial displacement of the central portion of the switch control element.

In another aspect, the invention comprehends a switch pad matrix comprised of a base to which is attached an array of spaced switch control elements as above described.

In another aspect, the invention covers a switch assembly incorporating the control device as a component.

BRIEF DESCRIPTION OF THE DRAWINGS

The invention in its preferred embodiments will be more particularly described by reference to the accompanying drawings, in which like parts are designated by like numerals in the various figures, and in which.

PREFERRED EMBODIMENTS OF THE INVENTION

Figure 1A:
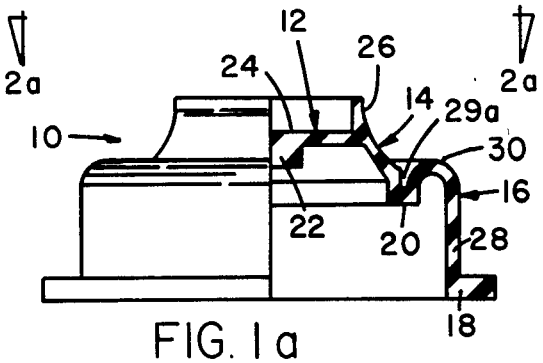
FIGS. 1*a*, 1*b*, 1*c*, 1*d* and 1*e* are elevational partial sectional views of an elastomeric switch control device of the invention shown in progressive stages of axial depression.

In its undepressed state, the control device shown generally at 10 in FIG. 1*a* is formed of a generally dome shaped elastomeric molding generally including a central portion 12, a first annular spring portion 14 and a second annular spring portion 16. The control device is also provided with a lower flange or marginal portion 18 to facilitate mounting in a switch assembly. Control device 10 is preferably formed from a suitable elastic polymeric material (herein "elastomeric") such as for example natural or synthetic rubber or thermoplastic elastomers, e.g., silicone rubber, polyurethane and EPDM. The control member is preferably formed as an integral molding using any suitable fabrication process such as compression molding or injection molding.

Figure 4:
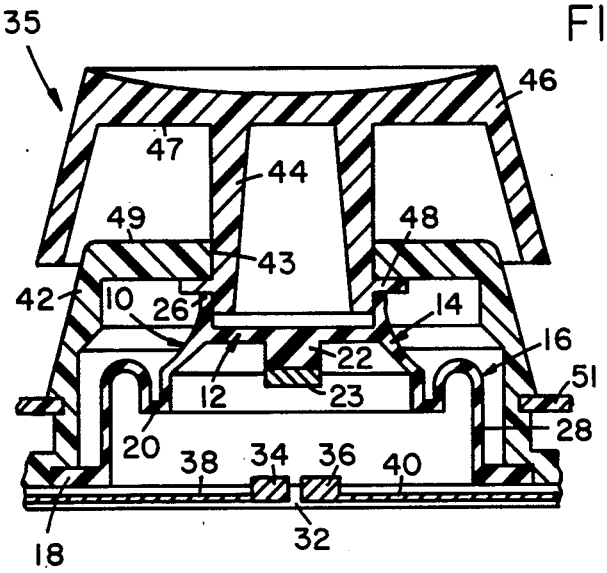
FIG. 4 depicts an elevational sectional view of a switch assembly.

The central portion 12 of the control device is provided with, preferably centrally thereof, movable switch actuation means such as protrusion 22. For use in a contact type switch such as shown in FIG. 4, protrusion 22 may be formed of a conductive material such as a rubbery polymer containing carbon black or other electroconductive filler (not shown), or may be nonconductive and carry an outer layer 23 of a conductive material such as a metal layer bonded to protrusion 22, or a layer of electroconductive ink or paint or the like. Alternatively, if the switch control device 10 of the invention is used in conjunction with a membrane type switch of the type shown, for instance, in the aforementioned U.S. Pat. No. 4,354,068, then as shown in FIG. 1 protrusion 22 need not be conductive or carry a conductive layer thereon. As a further alternative, in place of layer 23 one can attach a ferrite core for use in an indictive switch.

As will be appreciated, protrusion 22 should extend downwardly from planar portion 24 to the extent, if any, desired for overtravel of the switch (after the makepoint). The central portion 12 may also be provided with upstanding ring 26 adapted to mount a portion of the key top assembly as shown in FIG. 4 and described in more detail hereinafter.

Attached to central portion 12, and arranged coaxially therewith, is first annular spring portion 14, which undergoes a snap or reverse bending during operation of the control device to provide a tactile sensation to the operator. Spring portion 14 therefore may comprise a substantially straight sided inner surface and a curved edge outer portion which has a concave spherical curvature as shown. Alternatively spring portion 14 may have a convex spherical curvature, be straight sided in the shape of a truncated cone, or take on any other shape which provides a snap transformation upon axial depression of the control device beyond the breakover point of first spring portion 14.

Attached to the first spring portion 14, and coaxially arranged therewith, is second annular spring portion 16. This second spring portion, constructed as a rolling diaphragm, has an outer wall 28 which preferably extends substantially vertically forming a cylinder about the axis of the control device. Wall 28 connects to a roll portion 30 which, along with the wall portion may vary in thickness along the extent thereof to achieve the desired flexing properties and force response. Preferably the radial innermost portion of roll 30 turns downward as shown in FIG. 1*a* to define with spring portion 14 groove 29*a*, so that the diaphragm denoted as second spring portion 16 lacks substantial intrinsic structural resistance to a downward force distributed along this radial inner edge of the roll. Preferably the innermost portion of roll 30 extends substantially parallel to wall 28.

The first and second annular spring portions are preferably interconnected through an annular depending foot 20, which is preferably of generally U-shape as shown in FIG. 1*a* (further defining groove 29*a*). The lower portion of foot 20 is adapted in the embodiment of FIG. 1 to make abutting contact with a base surface (e.g., 32 of FIG. 4) of the switch assembly, as suggested by the configuration of the components of the device shown in FIG. 1*d* and as will be discussed in more detail hereinafter. Provision of wall portion 28 in the second spring portion serves in effect to support or suspend via roll 30 the first annular spring portion 14 together with the central portion 12 in a stable fashion, providing reduced stress during operation.

Figure 5:
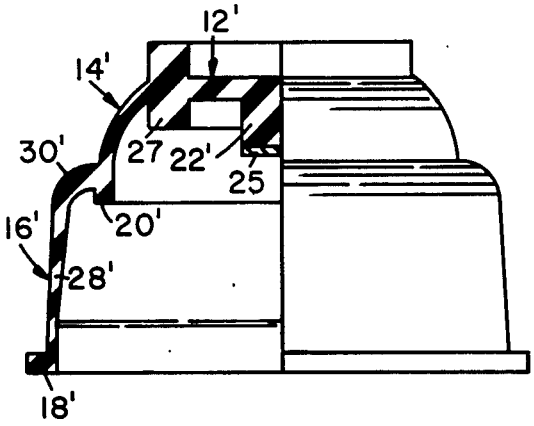
FIG. 5 is an elevational, partial sectional view of an alternative embodiment of the switch control device of the invention.

An alternative version of the dual spring switch control element of the invention is shown in FIG. 5. In this embodiment the central portion 12' includes centrally protruding button 22' which, together with conductive layer 25, is adapted to short a pair of contacts to actuate a switching device. The central portion is also provided with a downwardly protruding ring 27 which serves to limit the amount of overtravel as determined by its axial dimension.

In this embodiment the intermediate snap spring portion 14' is of convex-spherical shape and is interconnected to the rolling second annular spring portion 16' which terminates at marginal portion 18', through a T-interconnection. The lower portion of the T forms a depending foot 20' which operates similarly to foot portion 20 of the FIG. 1 embodiment. It is also noted in this embodiment that the thickness or gauge of wall 28' including wall 30' is tapered to provide desired flexing and force response characteristics.

By selecting the relative wall thicknesses throughout both the first and second spring portions of the embodiment of FIG. 5, one can adjust the "feel", excursion prior to snap, and like properties. For instance, by increasing the relative wall thickness at the lower portion of wall 28', and by reducing the wall gauge of spring portion 14', spring portion 14' can be made to snap prior to foot portion 20' making abutting contact with the base surface of the switch.

A representative assembly of the switch control device of the invention in an associated switch housing is shown in FIG. 4. The particular key and switching structure is merely representative and in itself forms no part of the invention. The key assembly shown generally at 35 is mounted to an insulating substrate or base surface 32 on which contacts 34, 36 are provided, respectively connected to conductor paths 38, 40. This structure may be in the form of a printed circuit board produced by conventional methods. Of course additional layers of insulation or other structure may be provided.

Figure 1B:
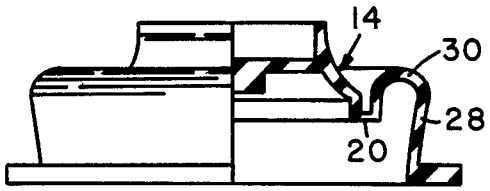
Figure 1C:
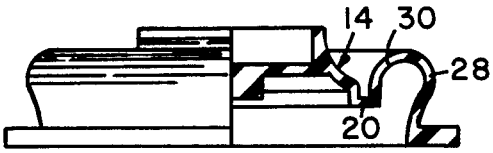
Figure 1D:
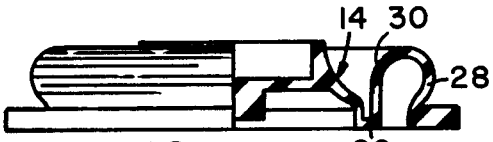
Figure 2A:
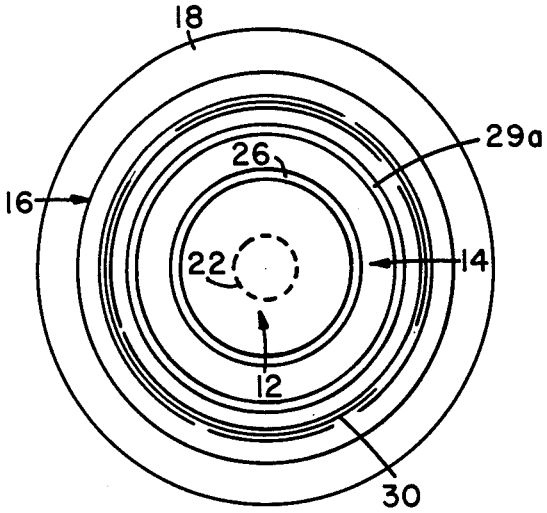
FIG. 2*a* is a top plan view of the control device in the neutral state shown in FIG. 1*a;*

The key assembly includes a key holder or housing 42 which clamps marginal portions 18 of the control element 10 against the substrate 32 e.g., printed circuit board, and serves as a guide for the actuating key top 46. Key holder 42 is provided with a central aperture 43 which slidingly receives key stem 44, which may be integral with the key top 46, depressible by the operator. Sufficient clearance is provided between the undersurface 47 of key top 46 and the top surface 49 of the key holder housing to allow full travel of control member 10 including the desired amount of overtravel. The spring control member 10 is coupled to key top 46 by a close fit between the depending portion of stem 44 and upstanding cylinder 26 of the central portion 12 of the control device. The lower portion of stem 44 may be bonded to portion 26 to prevent detachment. Stem flange portion 48 may be provided for further stability to ensure proper axial alignment. Substantial side clearance is provided between second spring portion 16 and the juxtaposed inner wall of housing 42 to allow substantially unobstructed bulging of sidewall portion 28 (as illustrated in FIGS. 1*b*–1*d*).

Key housing 42, which may be one key of an array of keys, may be mounted in a horizontally disposed cover plate or bezel 51 or the like.

Figure 6:
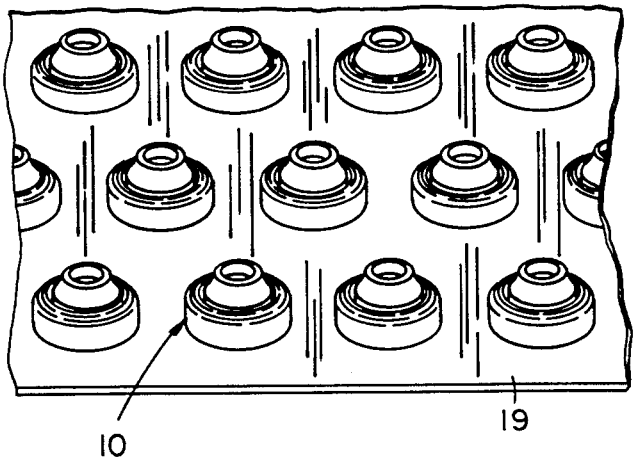
FIG. 6 is a perspective view of an elastomeric switch-pad having multiple switch control elements integrally joined together for use in a keyboard.

The invention is also clearly applicable to arrays of switches and in this respect multiple control elements 10 may be joined together in spaced relationship by attachment to a common base 19, shown in FIG. 6. Base 19 and elements 10 may be molded integrally of a suitable elastomer. The particular matrix of FIG. 6 may serve as the spring control portion for a data entry QWERTY keyboard, for instance.

Figure 3:
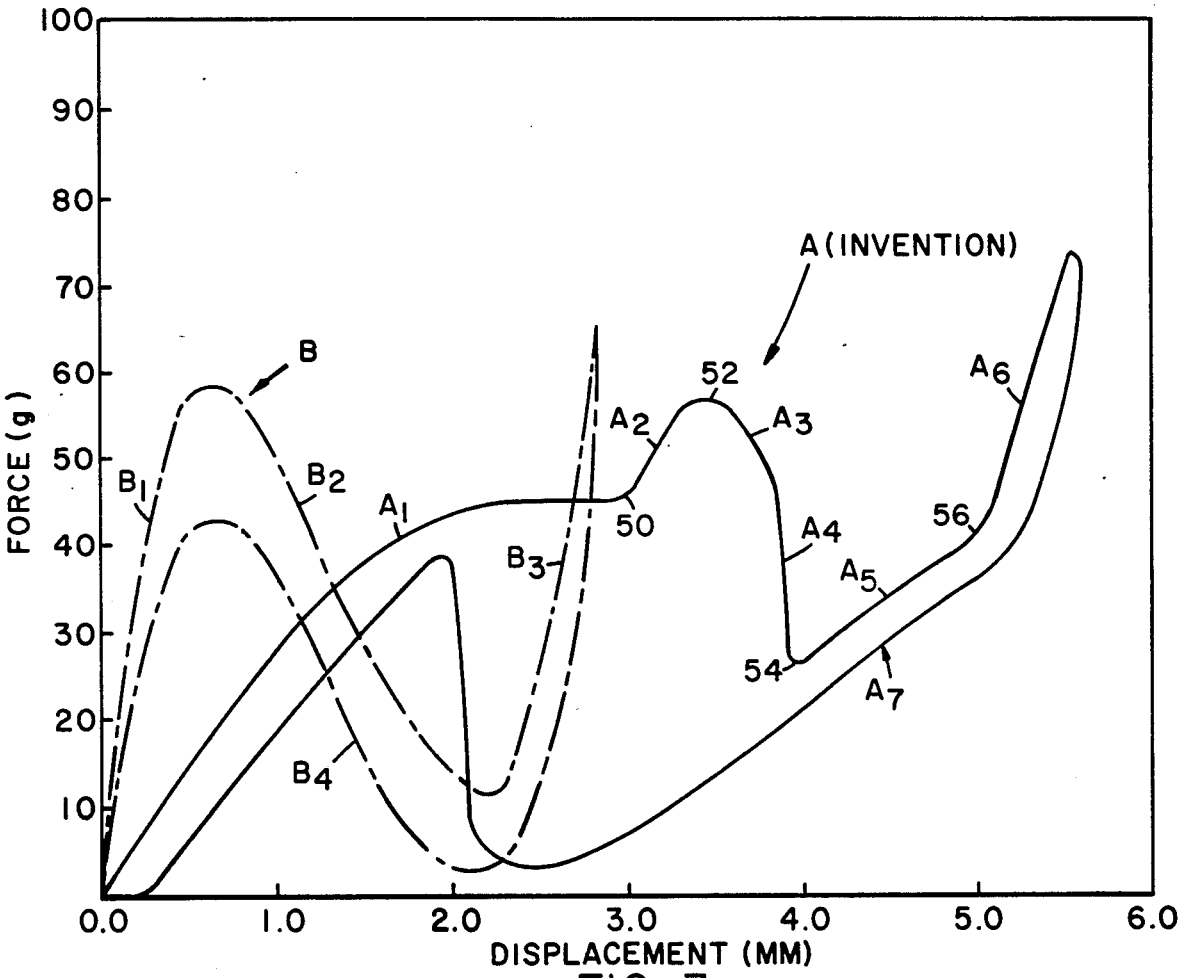
FIG. 3 is a plot of force, in grams, versus displacement, in millimeters, of the control device of FIGS. 1*a–e* (shown as Curve A in solid line), and compared to the force displacement plot of the central portion 12 together with the annular concave-spherical spring portion 14 only (shown as Curve B in broken line)

The operation of the control member of the invention will be described hereinafter particularly with reference to FIGS. 1*a*–1*e* and FIG. 4, in conjunction with the associated force/displacement curve of FIG. 3, which is merely illustrative of one form of the invention. When a user depresses key top 46, the central portion 12 of the control device will be displaced axially downwardly as illustrated in FIG. 1*b* causing wall 28 and roll portion 30 to undergo a simultaneous bulging and rolling as shown (this state can also be represented by a conventional preload condition on the key, e.g., 20–35 grams). Depending upon the wall thickness and geometry of first annular spring portion 14, this portion may undergo a slight flattening. With further depression of the key assembly, further bulging of wall 28 and rolling will take place as shown in FIG. 1*c*.

As the key top and control device are still further depressed to the state shown in FIG. 1*d*, foot portion 20 will preferably be brought into abutting contact with the substrate or base surface 32 (FIG. 4), with second annular spring portion or diaphragm 16 having undergone its full rolling action (and bulging). Up to this point, shown at 50 along Curve A and specifically segment $A_1$, the force has increased monotonically as a function of axial displacement.

Figure 1E:
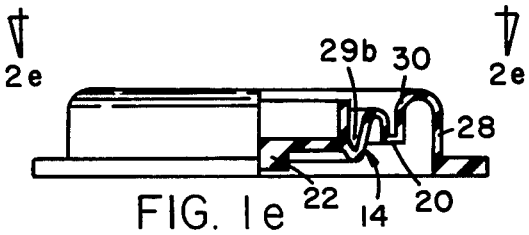
Figure 2E:
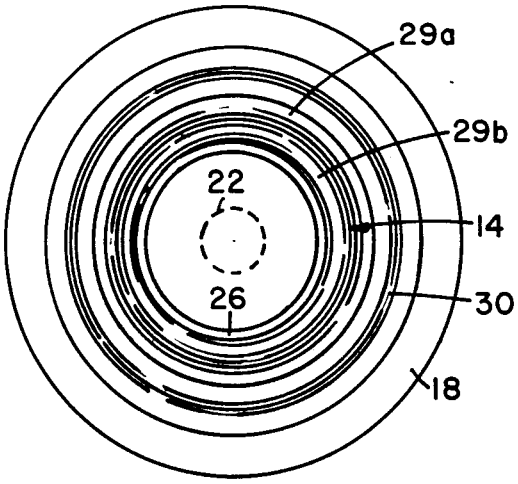
FIG. 2*e* is a top plan view of the control device in the depressed state shown in FIG. 1*e;*

As the control device shown in its state in FIG. 1*d* is depressed further, the sidewall of first spring portion 14 is flexed and there is an increase in force from point 50 to point 52 following Curve $A_2$, the slope of which is determined by the physical properties of portion 14. At the peak force point 52 first annular spring portion 14 undergoes a snap transformation and the operator will clearly feel a reduced biasing force as the central portion 12 is displaced from point 52 to point 54 along Curves $A_3$ and $A_4$. Although Curve $A_2$ substantially conforms to Curve $B_1$ (representing a segment of the force displacement characteristic of the central portion 12 and first annular spring portion 14 taken alone), and the early portion $A_3$ of the breakover curve after snap is similar to the upper portion of Curve $B_2$ as might be expected, during the mid portion of breakover an unexpected avalanche drop in force is experienced as depicted by Curve $A_4$. This has been found to be extremely beneficial and is attributed to the additional restoring force supplied by the second annular spring portion 16. The bulged or rolled wall portion 28 and roll 30 help thrust or catapult the intermediate foot portion 20 upwardly together with sidewall 14 into its reverse snapped position, producing a second groove 29*b*, as illustrated in FIGS. 1*e* and 2*e*.

At this juncture, represented by point 54 on Curve A, actuation means 22 through conductive layer 23 or other means, has made contact across contacts 34, 36 to close the associated circuit, establishing the so-called makepoint. In practice, the makepoint can occur at any point subsequent to (to the right of) point 52, but preferably prior to point 56, which represents the primary overtravel increment as planar surface 24 of the central portion of the control device is bent downwardly toward substrate surface 32. Futher depression of the key causes additional overtravel along Curve $A_6$ as protrusion 22 is compressed (corresponding to Curve $B_3$).

Upon release of the depressed key, the return force-displacement relationship is represented by Curve $A_7$, which provides a very desirable low force level that doesn't tend to push the operator's finger back to the neutral position with as much force as with conventional elastomeric control devices. A substantial hysteresis results, particularly compared with a typical return hysteresis curve similar to that shown at $B_4$.

While certain representative embodiments and details have been shown for the purpose of illustrating the invention, it will be apparent to those skilled in this art that various changes and modifications may be made therein without departing from the spirit or scope of the invention. For instance, while the control device has been illustrated in combination with a separate key top actuator in FIG. 4, the central portion 12 of the control device can be designed to itself serve the combined function of switch control device and key top. In that case the upper surface of central portion 12 may be suitably imprinted directly with an alphanumeric or other desired symbol. This embodiment, as well as the FIG. 4 embodiment, is resistant to asymmetric collapse when subjected to off-center applied force i.e., it tends to self-center. As another example, while the invention has been described in respect to a dual spring control device, clearly additional spring members of desired type may be incorporated, to provide three or more interconnected spring portions of desired geometry.

What is claimed is:

1. An elastomeric switch control element providing a tactile feel in operation thereof, comprising:

a central portion including switch actuation means;

a first annular spring portion, attached to the central portion, adapted to flex and after predetermined axial displacement of the central portion in excess of a breakover amount, to undergo a snap transformation, and a second annular spring portion, coaxially arranged with and attached to the first annular spring portion, at least a portion of which extends radially outwardly from said first annular spring portion, and which, in operation, undergoes a rolling action upon axial displacement of the central portion of the switch control element, and in which switch actuation occures after said central portion has been displaced at least about said breakover amount.

2. The switch control element of claim 1 wherein the first spring portion is selected from convex-spherical, concave-spherical and truncated conical.

3. A switch pad comprising a base to which is attached a plurality of spaced control elements constructed in accordance with claim 1.

4. The switch control element of claim 1 wherein switch actuation occurs after said central portion has been displaced an amount in excess of the breakover amount and after snap of the first annular spring portion.

5. The switch control element of claim 1 wherein the second spring portion is formed of a rolling diaphragm comprising an upstanding wall joined to a radially inwardly disposed annular roll portion, and wherein in operation of the device an avalanche dropoff in reaction force results as the first annular spring portion undergoes said snap transformation.

6. The switch control element of claim 5 wherein the annular roll portion has a downturned portion which extends substantially parallel to said upstanding wall.

7. The switch control element of claim 1 wherein the first and second spring portions are interconnected through an annular depending foot portion.

8. The switch control element of claim 7 wherein the foot portion is adapted in operation to make abutting contact against a base surface, adjacent which the switch control element is mounted, prior to switch actuation and prior to the first spring portion undergoing said snap transformation.

9. The switch control element of claim 7 wherein the foot portion is generally U-shaped.

10. An elastomeric switch control element comprising:

a central portion including switch actuation means;

a first annular spring portion, attached to the central protion, adapted to flex and after predetermined axial displacement of the central portion in excess of a breakover amount, to undergo a snap transformation; and a second annular spring portion; coaxially arranged with and attached to the first annular spring portion at the outer side thereof through an interconnecting portion, which second spring portion, in operation, flexes and bulges radially outwardly upon axial displacement of the central portion of the switch control element, and in which, switch actuation occurs after said central portion has been displaced at least about said breakover amount.

11. The switch control element of claim 10 wherein switch actuation occurs after said central portion has been displaced an amount in excess of the breakover amount and after snap of the first annular spring portion.

12. The switch control element of claim 10 wherein the first and second annular spring portions are attached through a generally U-shped foot interconnecting portion.

13. The switch control element of claim 12 wherein the foot portion is adapted in operation to make abutting contact against a base surface, adjacent which the switch control element is mounted, prior to switch actuation and prior to the first spring portion undergoing said snap transformation

14. The switch control element of claim 12 wherein the foot portion is adapted in operation to make abutting contact against a base surface, adjacent which the switch control element is mounted, prior to the first spring portion undergoing said snap transformation.

15. A keyswitch assembly comprising:

a key holder housing having an aperture and an inner wall;

a switch control device contained within the the housing and comprising (i) a central portion including switch actuation means, (ii) a first annular spring portion attached to the central portion, adapted to undergo a snap transformation after a given axial displacement of the central portion in excess of a breakover amount, and (iii) a second annular spring portion, coaxially arranged with and attached to the first annular spring portion with at least a portion of the second spring portion extending radially otuwardly from said first spring portion, which, in operation, flexes and substantially freely bulges radially outwardly without substantially contacting the inner wall of the key holder housing;

a key top mounted to said housing and including means passable through said aperture for transmitting force applied to the key top to the switch control device, for actuating a switch device; and whereby in operation switch actuation occurs after said central portion has been displaced at least about said breakover amount.

16. A keyboard having a plurality of keyswitches in accordance with claim 15, and wherein the switch control devices are formed of a base to which the individual switch control devices are attached in a spaced matrix.

17. The keyboard of claim 16 wherein the base and spaced switch control devices are formed of an integral molding of an elastomeric material.

18. An elastomeric switch control element comprising:

a central portion including switch actuation means;

a first annular spring portion, attached to the central portion, adapted to flex and after a predetermined axial displacement of the central portion in excess of a breakover amount, to undergo a snap transformation; and a second annular spring portion, coaxially arranged with and attached to the first annular spring portion at the outer side thereof, which in operation flexes and bulges radially outwardly and simultaneously undergoes a rolling action upon axial displacement of the central portion of the switch control element, and in which switch actuation occurs after said first annular spring portion has undergone said snap transformation.

19. The switch control element of claim 18 wherein the first and second spring portions are interconnected through an annular depending U-shaped foot portion.

* * * * *